US011357321B2

(12) United States Patent
Molinar et al.

(10) Patent No.: US 11,357,321 B2
(45) Date of Patent: Jun. 14, 2022

(54) PORTABLE TABLE

(71) Applicants: Jennifer Alexis Molinar, Missoula, MT (US); Raoul Molinar, Missoula, MT (US)

(72) Inventors: Jennifer Alexis Molinar, Missoula, MT (US); Raoul Molinar, Missoula, MT (US)

( * ) Notice: Subject to any disclaimer, the term of this patent is extended or adjusted under 35 U.S.C. 154(b) by 0 days.

(21) Appl. No.: 17/019,073

(22) Filed: Sep. 11, 2020

(65) Prior Publication Data

US 2021/0068534 A1 Mar. 11, 2021

Related U.S. Application Data

(60) Provisional application No. 62/898,823, filed on Sep. 11, 2019.

(51) Int. Cl.

*A47B 13/02* (2006.01)
*A47B 3/04* (2006.01)
*A47B 13/08* (2006.01)

(52) U.S. Cl.

CPC ..... *A47B 13/02* (2013.01); *A47B 3/04* (2013.01); *A47B 13/08* (2013.01); *A47B 2200/0012* (2013.01); *A47B 2200/0017* (2013.01); *A47B 2200/0032* (2013.01); *A47B 2200/08* (2013.01)

(58) Field of Classification Search

CPC ..... A47B 13/02; A47B 13/08; A47B 3/04; A47B 3/06; A47B 2200/0012; A47B 2200/0017; A47B 2200/0032; A47B 2200/08; A01K 1/0353

USPC .... 108/129, 153.1, 155, 156, 157.1, 157.14; 403/220; 135/127; 248/97, 95, 99

See application file for complete search history.

(56) References Cited

U.S. PATENT DOCUMENTS

| | | | | | |
|---|---|---|---|---|---|
| 1,135,707 | A | * | 4/1915 | Mattes | A47C 17/64 5/113 |
| 1,820,285 | A | * | 8/1931 | Mills | A47C 19/12 5/187 |
| 2,646,577 | A | * | 7/1953 | Thayer | A47C 17/68 5/114 |
| 2,871,489 | A | * | 2/1959 | Emmert | A47C 17/70 5/114 |
| 3,227,111 | A | * | 1/1966 | Rainwater | E04H 15/46 108/129 |

(Continued)

FOREIGN PATENT DOCUMENTS

| | | | |
|---|---|---|---|
| FR | 1388306 | * | 3/1964 |
| FR | 2402430 | * | 4/1979 |
| WO | 2018229725 | * | 12/2018 |

*Primary Examiner* — Janet M Wilkens

(57) ABSTRACT

The portable table described herein includes: hubs respectively installed at front left, front right, rear left, and rear right corners of the table; four frames separably connecting to the hubs to form a four sided table top; front left, front right, rear left and rear right leg frames, each respectively having base ends separably coupled to the surfaces of the respective hubs and respectively having free ends disposed in a manner extending toward the ground surface; and a top sheet coupled to the support frames forming a table top with four leg frames. The leg frames may be of differing length to position the table in a more level position when placed on a non-level surface. The structural rigidity is excellent, and the table may stand on a surface in a stable position.

7 Claims, 7 Drawing Sheets

(56) References Cited

U.S. PATENT DOCUMENTS

| | | | | |
|---|---|---|---|---|
| 3,298,328 | A * | 1/1967 | Hoodis | A47B 3/083 108/129 |
| 5,352,015 | A * | 10/1994 | Morgan | A47B 3/04 297/463.1 |
| 5,421,273 | A * | 6/1995 | Lin | A47B 3/04 108/187 |
| 6,679,644 | B1 * | 1/2004 | Heller | A63H 33/10 135/127 |
| 7,681,524 | B1 * | 3/2010 | Hudson | A01K 15/024 119/28.5 |
| 8,919,284 | B2 * | 12/2014 | Wolfe, Jr. | A01K 1/0353 119/28.5 |
| D928,420 | S * | 8/2021 | Xu | D30/118 |
| 2003/0024560 | A1 * | 2/2003 | Tomason | E04H 15/324 135/90 |
| 2005/0044630 | A1 * | 3/2005 | Danaher | E04H 15/40 5/414 |
| 2005/0051106 | A1 * | 3/2005 | Tulgren | A01K 15/024 119/28.5 |
| 2005/0103279 | A1 * | 5/2005 | Brewer | A01K 1/033 119/498 |
| 2014/0250593 | A1 * | 9/2014 | Kim | A47C 17/645 5/114 |
| 2015/0059089 | A1 * | 3/2015 | Falkiner | B60N 2/2854 5/110 |

* cited by examiner

PORTABLE TABLE

CLAIM TO PROVISIONAL PATENT

This application claims priority to non-provisional application No. 62/898,823 filed on Sep. 11, 2019, and all benefits accruing therefrom, the contents of which in its entirety are incorporated herein by reference.

FIELD

Embodiments described herein relate to a portable table which is easily folded and unfolded for storage and transportation, and may be adjusted to surfaces which are not level.

SUMMARY

Portable tables have existed for a long period of time. These portable tables include methods for folding or retracting the legs, or folding the table surface using a hinge or other mechanism. These portable tables fail to collapse or retract into a compact form due to their rigid tops, limited folding or retracting apparatus, and the parts remain attached in inflexible and awkward ways. Further, these tables fail to provide a level surface when erected on any non-level surface. The portable table described herein collapses into a very compact portable form, allows the parts to remain attached yet are flexible and easy to arrange. The table top itself remains rigid while erected and rolls up compactly when stored. Lastly, the table provides a level surface even when erected on non-level surfaces of varying degrees, whether on the ground or on another non-level surface (for example, the tailgate of a pickup truck, wing of an airplane, or bow of a boat).

The present disclosure is directed to providing a portable table that solves the weaknesses and faults of portable tables in use today. The portable table makes up for the weaknesses in collapsing, compacting for transport, and being useful on non-level surfaces. Specifically, the present disclosure is directed to providing a portable table that is easily folded and unfolded through the use of at least one elastic string, is simply transported due to a small volume when collapsed, has excellent support rigidity, and can be effectively used on a non-level surface.

In one aspect, there is provided a portable table including: four hubs respectively installed at front left, front right, rear left, and rear right corners of the table, which connect to four support frames forming the outside of the table top, and four leg frames, that may be of different lengths, supporting each of the four hubs, and a top sheet of fabric, for example, forming the table top. All support frames may be connected to and separated from the hubs but remain connected together by one or more elastic strings that allow the frames to be laid over each other in a variety of ways to compact the table. Coupling holes may be provided in the inner surface sides of the hubs, and both ends of a support frame may be inserted into the coupling holes, and the leg frames may be inserted into yet other coupling holes in the hubs. The top sheet well may be completely removed and folded or rolled as needed for transportation of storage. The ability to separate the frames, hubs, and top sheet allows significant reduction in the space required to transport or store the portable table.

One embodiment described herein describes each of the frames as a hollow tube that may be connected to any one frame other than itself through one or more elastic strings passing through one or more hollow frames and also through the hubs. Each of the one or more elastic strings connects to the end of one or more of the frames, keeping those frames and any hubs through which the elastic string passes together for quick reassembly. This makes erecting the table simple—there is little or no chance of placing a frame in an incorrect position while also allowing simple collapse of the table by extending the elastic string to permit each frame to be located as best fits the transportation or storage need.

Another embodiment described herein the leg frames consist of different lengths, for example the front leg frames may be longer than the rear leg frames allowing the portable table to be leveled on a non-level surface (i.e. a hill at an outdoor concert). In another example embodiment the leg frames may be adjustable by adjusting the length of the elastic string thus allowing the table to be adjusted to a non-level surface.

DETAILED DESCRIPTION

One or more embodiments are described and illustrated in the following description and accompanying drawings. These embodiments are not limited to the specific details provided herein and may be modified in various ways. Other embodiments may exist that are not described herein. Also, the functionality described herein as being performed by one component may be performed by multiple components in a single or multi-step manner. Likewise, functionality performed by multiple components may be consolidated and performed by a single component. Similarly, a component described as performing particular functionality may also perform additional functionality not described herein. For example, a device or structure that is "configured" in a certain way is configured in at least that way, but may also be configured in ways that are not listed. Furthermore, some embodiments described herein may include additional parts for enhancing connectivity without adding or altering the functionality described herein.

In addition, the phraseology and terminology used herein is for the purpose of description and should not be regarded as limiting. For example, the use of "including," "containing," "comprising," "having," and variations thereof herein is meant to encompass the items listed thereafter and equivalents thereof as well as additional items. The terms "connected" and "coupled" are used broadly and encompass both direct and indirect connecting and coupling. Further, "connected" and "coupled" are not restricted to physical or mechanical connections or couplings and can include wired, tied, hooked, glued, or couplings, whether direct or indirect. Moreover, relational terms such as first and second, front and rear, left and right, top and bottom, and the like may be used herein solely to distinguish one entity or action from another entity or action without necessarily requiring or implying any actual such relationship or order between such entities or actions.

Figure 1:
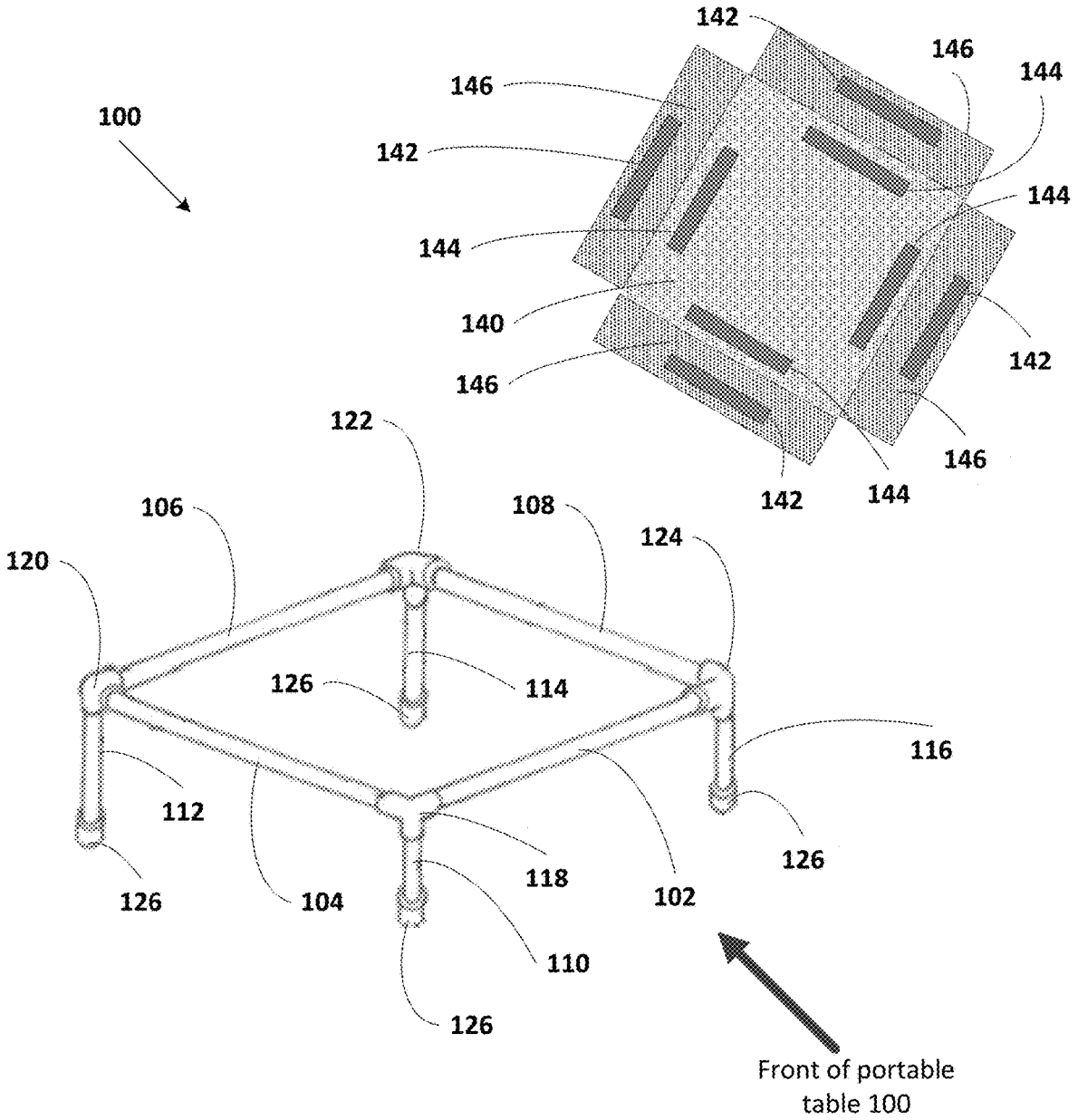
FIG. 1 schematically illustrates an embodiment of the portable table with the frames, hubs, and leg ends assembled and the top liner detached.

FIG. 1 illustrates embodiment of portable table 100 with frames, hubs, and leg ends assembled and the top liner detached. The front of the portable table 100 faces to the right of the figure with the front legs shown in this embodiment as shorter than the rear legs. Portable table 100, in this embodiment, includes front support frame 102, left-side support frame 104, rear support frame 106, and right-side support frame 108, front left leg frame 110, rear left leg frame 112, rear right leg frame 114, and front right leg frame 116. Front support frame 102, left-side support frame 104, and front left leg frame 110 are separably connected by front left hub 118. Similarly, left-side support frame 104, rear support frame 106, and rear left leg frame 112 are separably connected by rear left hub 120, rear support frame 106, right-side support frame 108, and rear right leg frame 114 are separably connected by rear right hub 122, and right-side support frame 108, front support frame 102, and front right leg frame 116 are separably connected by front right hub 124. Each of front left leg frame 110, rear left leg frame 112, rear right leg frame 114, and front right leg frame 116 are connected to leg caps 126, respectively.

Figure 2:
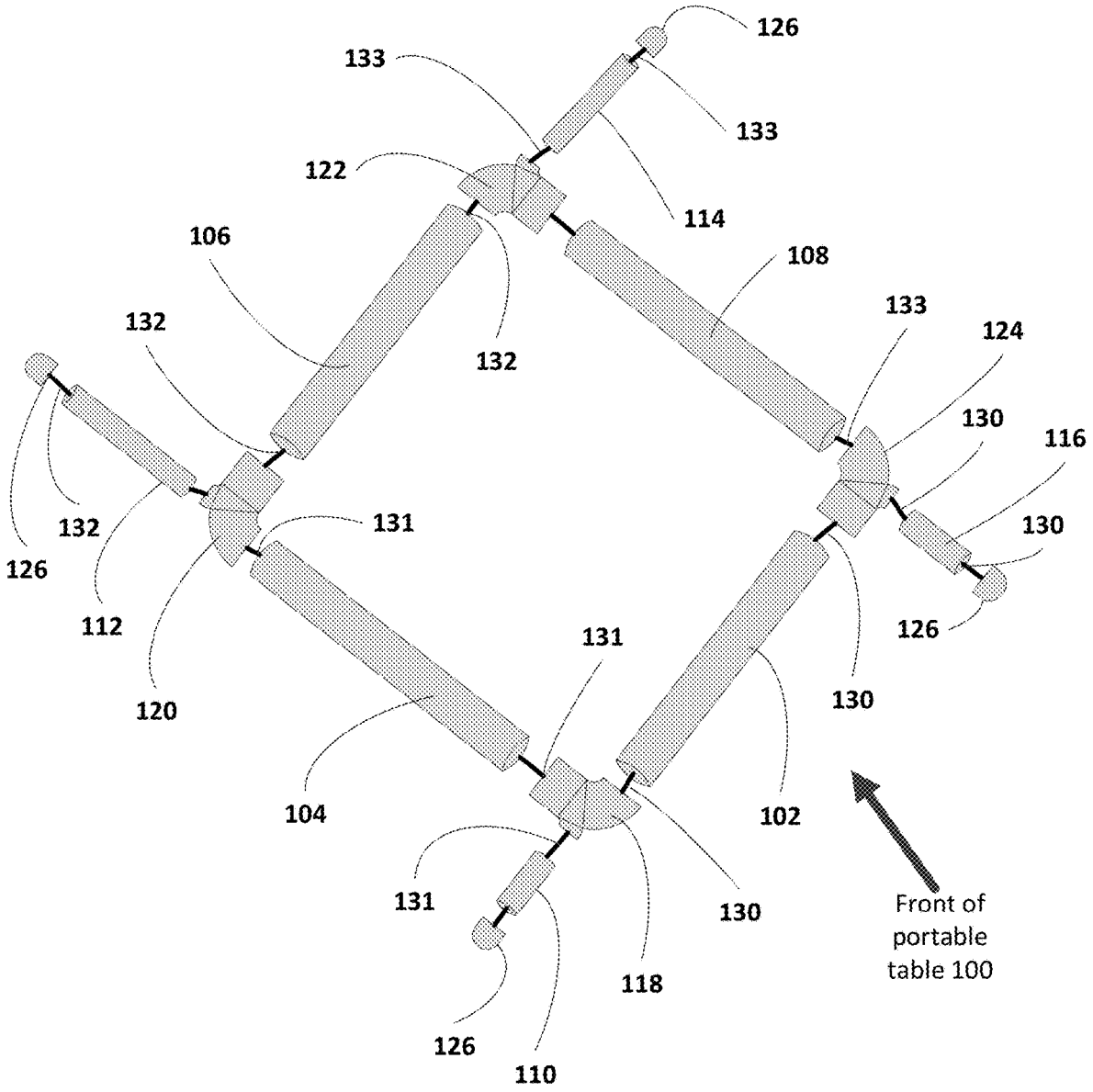
FIG. 2 shows an embodiment of the portable table with the frames, hubs, and legs separated, and the elastic string attached.

At least one elastic string, and in this embodiment four elastic strings which are not visible in FIG. 1 but as shown in FIG. 2, connects to at least one leg cap 126 and extends through at least one leg frame, which may be a hollow tube, through at least one hub, and optionally through a support frame, before being attached to another elastic string in the example embodiment shown in FIG. 1, or, in some embodiments, to another leg cap 126, or to a hub or frame in yet other embodiments. The elastic string allows the frames and hubs to be separated from each other and laid parallel to each other, for example, to facilitate transportation or storage. In addition, the elastic string maintains the correct connections between the frames and the hubs allowing for easy reassembly when needed.

Also shown in the example embodiment in FIG. 1 is top sheet 140. Top sheet 140 includes at least one first adhesive strip 142 attached to the top sheet 140 and at least one second adhesive strip 144 attached to the top sheet 140. In the example embodiment of FIG. 1, the bottom of top sheet 140 is shown, wherein the first adhesive strip 142 is attached to flap 146 of top sheet 140 and flap 146 of top sheet 140 wraps around one support frame, such as right-side support frame 108 in such a manner that allows first adhesive strip 142 to adhere to second adhesive strip 144. In a like manner the four flaps 146 wrap around each support frame, allowing first adhesive strips 142 to attach to second adhesive straps 144 forming the top surface of the table.

Figure 5:
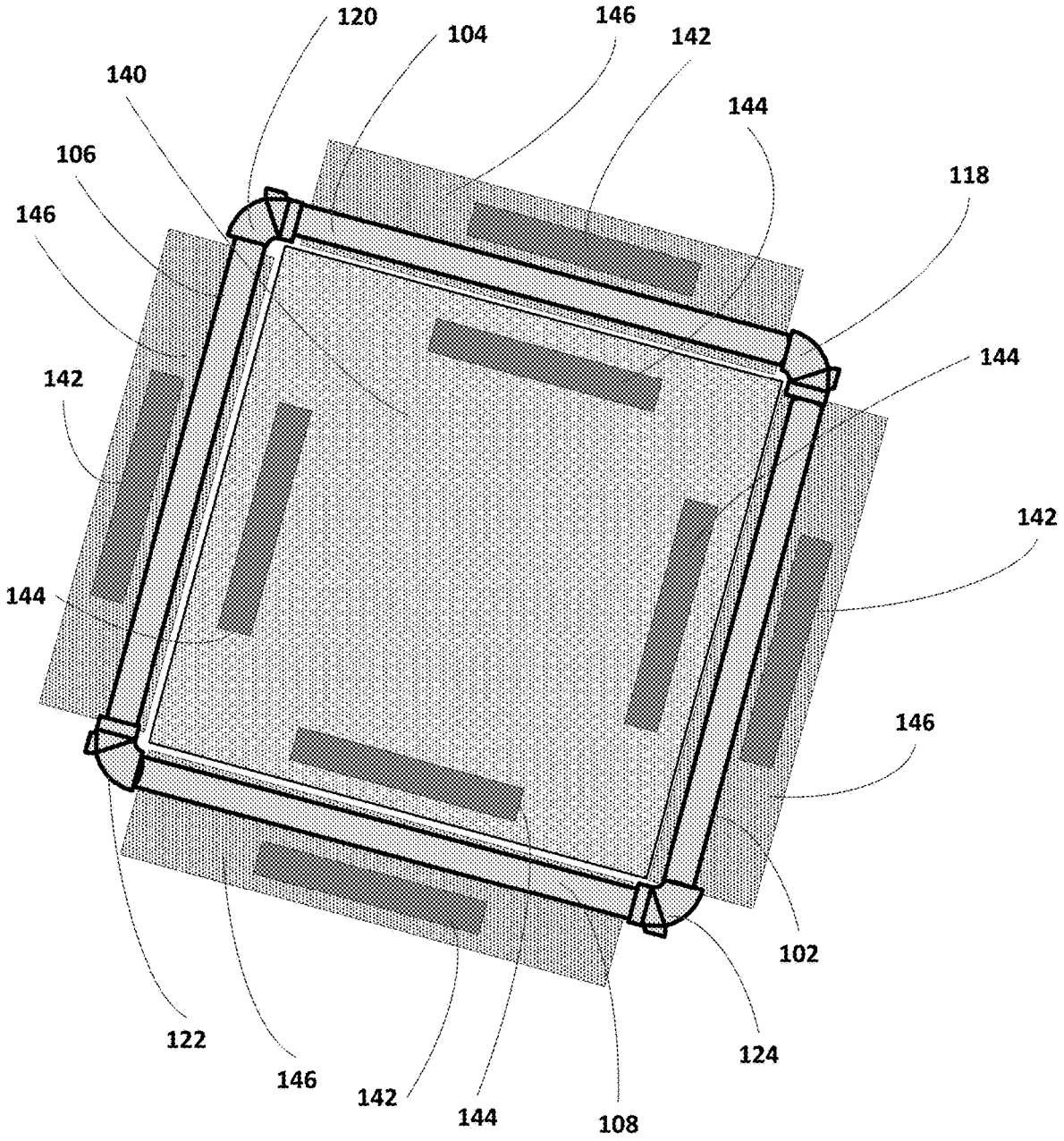
FIG. 5 illustrates support frames placed on the underside of the top sheet and the adhesive strips which attach the top sheet to the support frames in an example embodiment.

The top sheet 140, in this embodiment, is attached to the support frames, namely front support frame 102, left-side support frame 104, rear support frame 106, and right-side support frame 108, by pulling the flaps 146 tightly around, to form the portable table 100. The top sheet is separably connected wherein the first adhesive strip 142 can be detached from the second adhesive strip 144 and folded, rolled, or otherwise compacted into a form allowing easier transportation and storage. FIG. 5 further illustrates the attachment of top sheet 140 to front support frame 102, left-side support frame 104, rear support frame 106, and right-side support frame 108.

The example embodiment of FIG. 1 shows the portable table 100 as two separable parts, namely the support frames, hubs, and leg frames forming the frame and the top sheet 140. One skilled in the art will understand the two separable parts may be further separated and will also understand how the parts connect to form a table. The embodiment shown in FIG. 1 is one example embodiment and does not limit the number of parts or their connectivity.

FIG. 2 illustrates an exploded view of the frame in one example embodiment of portable table 100, which aligns with FIG. 1 wherein the front of the portable table 100 faces the right side of FIG. 2. As described in FIG. 1, the support frames and leg frames are separably connected by the hubs. In the embodiment shown in FIG. 2, front support frame 102, left-side support frame 104, and front left leg frame 110 are disconnected from front left hub 118. Similarly, left-side support frame 104, rear support frame 106, and rear left leg frame 112 are disconnected from rear left hub 120, rear support frame 106, right-side support frame 108, and rear right leg frame 114 are disconnected from rear right hub 122, and right-side support frame 108, front support frame 102, and front right leg frame 116 are disconnected from front right hub 124. Leg caps 126 are shown disconnected from front left leg frame 110, rear left leg frame 112, rear right leg frame 114, and rear front leg frame 116 to show the connectivity and path of at first elastic string 130, second elastic string 131, third elastic string 132, and fourth elastic string 133. Leg caps 126 may be separably connected to leg frames or affixed to leg frames, without limiting the scope or functionality of the portable table 100.

Figure 3:
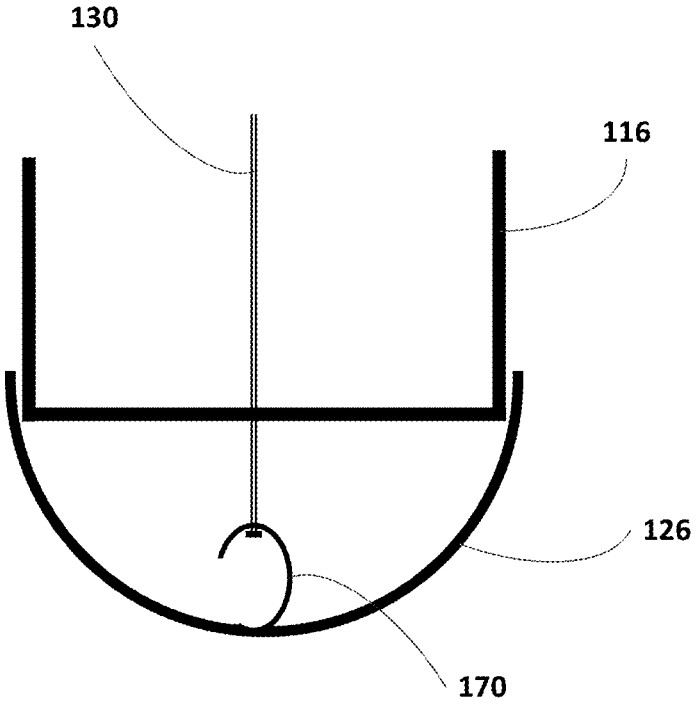
FIG. 3 depicts one embodiment of the portable table cap end wherein the elastic string is shown attached to a leg cap.
Figure 4:
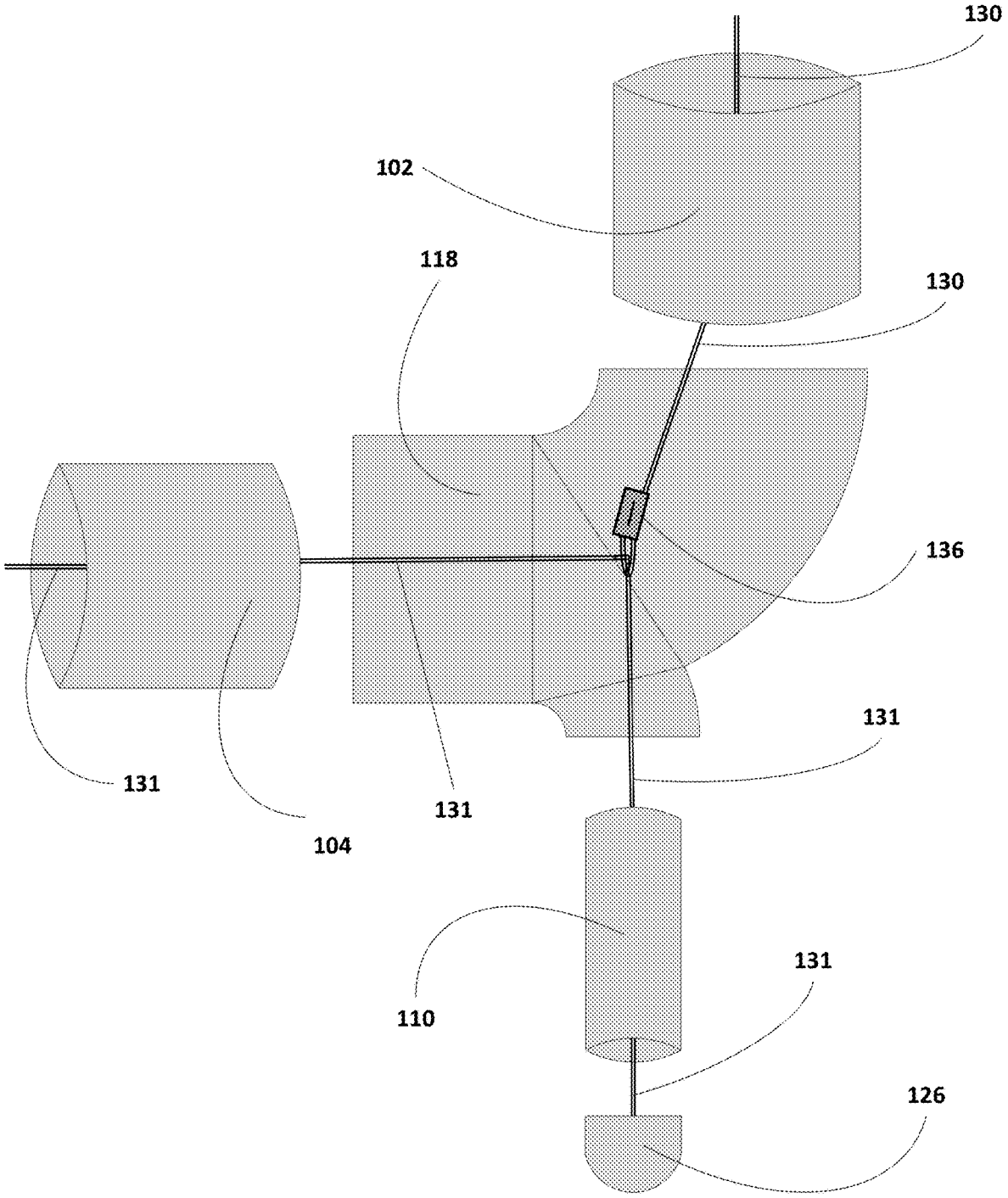
FIG. 4 illustrates one embodiment of the connection of elastic strings within a hub.

As shown in the example embodiment in FIG. 2, first elastic string 130 connects to leg cap 126 where such connection is shown in more detail in FIG. 3, runs through front right leg frame 116, front right hub 124, front support frame 102, and connects to second elastic string 131 in front left hub 118, where such connection is shown in more detail in FIG. 4. Similarly, second elastic string 131 connects to leg cap 126, runs through front left leg frame 110, front left hub 118, left-side support frame 104, and connects to third elastic string 132 in rear left hub 120. Continuing, third elastic string 132 connects to leg cap 126, runs through rear left leg frame 112, rear left hub 120, rear support frame 106, and connects to fourth elastic string 133 in rear right hub 122. Fourth elastic string 133 connects to leg cap 126, runs through rear right leg frame 114, rear right hub 122, right-side support frame 108, and connects to first elastic string 130 in front right hub 124. One skilled in the art will recognize this example embodiment connects all four elastic strings, namely first elastic string 130, second elastic string 131, third elastic string 132, and fourth elastic string 133, and connect each elastic string to the frame by connecting to leg caps 126 thus keeping all frames, hubs, legs, and caps connected yet allowing them to be separated for transport or storage.

The elastic strings, namely first elastic string 130, second elastic string 131, third elastic string 132, and fourth elastic string 133, may be used in parallel or may cross over one another to reinforce the elasticity, strength, or tension of the connect, or any or all of these reinforced properties, allow or support assembling portable table 100 by pulling frames and hubs together. Similarly, when frames and hubs are separated, the elastic strings in this embodiment allow the frame of portable table 100 to be more easily assembled by connecting appropriate frames, legs, and hubs by being guided by the elastic string connections to other elastic strings and leg caps 126, through the frames, hubs, and legs. In some embodiments the frames and hubs may pull themselves into correct connections, or nearly do so and require only minimal assistance or adjustment by the user.

FIG. 3 illustrates an example embodiment of connecting first elastic string 130 to leg cap 126 using hook 170 as a fastener. Without loss of detail, FIG. 3 shows the connection of front right leg frame 116 to leg cap 126. First elastic string 130 connects to leg cap 126 using hook 170 as one embodiment of the fastener. Front right leg frame 116 is hollow, which is not shown in FIG. 3, but one skilled in the art will recognize the bottom horizontal edge of front left leg frame 116 represents the outside of the hollow front left leg frame 116. Hook 170 may connect to leg cap 126 using an adhesive such as glue, or may be inserted into leg cap 126 with a screw or bolt, or some other connection without limiting the scope or functionality of the invention. First elastic string 130 connects to hook 170 using a knot, an adhesive, or is wrapped around hook 170 and clamped with a secure clip, clamp, or staple, or a combination of these methods may be used. Additional methods may be used to connect first elastic string 130 to hook 170 without loss of scope or functionality. Similarly, second elastic string 131 connects to leg cap 126, third elastic string 132 connects to leg cap 126, and fourth elastic string 133 connects to leg cap 126 using the method shown in FIG. 3. One skilled in the art will recognize that more than one connection method for hook 170 to leg cap 126 may be used in an alternative embodiment and more than one connection method for elastic strings 130, 131, 132, and 133 may be used to hook 170 may be used in an embodiment without loss of scope of function.

FIG. 4 illustrates an example embodiment of the connection between elastic strings in a hub, specifically left front hub 118 of portable table 100. First elastic string 130 runs through front support frame 102 and into the hollow portion of left front hub 118 where first elastic string 130 forms a loop which is connected to itself by clamp 136. Second elastic string 131 connects to leg cap 126, as shown in FIG. 3, runs through front left leg frame 110, into the hollow portion of front left hub 118 where in passes through the loop formed by first elastic string 130 and then passes out of front left hub 118 and through right-side support frame 104. Second elastic string enters left rear hub 120 (not shown) and forms a loop similar to that formed by first elastic string 130 as shown in FIG. 3. Third elastic string 132 and fourth elastic string 133 form similar loops in right rear hub 122 and front right hub 124, respectively.

FIG. 5 illustrates one example embodiment of the portable table 100 with the top frames and hubs assembled and shown placed over the underside of the top sheet 140. Leg frames are not shown in this illustration to clarify and illustrate the connecting the top sheet 140 to the assembled frame. Portable table 100, in this embodiment, includes front support frame 102, left-side support frame 104, rear support frame 106, and right-side support frame 108. Front support frame 102 and left-side support frame 104 are separably connected by front left hub 118. Similarly, left-side support frame 104 and rear support frame 106 are separably connected by rear left hub 120, rear support frame 106 and right-side support frame 108 are separably connected by rear right hub 122, and right-side support frame 108 and front support frame 102 are separably connected by front right hub 124.

Also shown in the example embodiment in FIG. 5 is top sheet 140. This embodiment illustrates the underside of the top sheet 140. Top sheet 140 includes flaps 146 which extend over front support frame 102, left-side support frame 104, rear support frame 106, and right-side support frame 108. Attached to each flap 146 is a first adhesive strip 142 placed toward the outer edge of the top sheet 140. Towards the center of top sheet 140 relative to each first adhesive strip 142, a second adhesive strip 144 is attached to the top sheet in a position that allows first adhesive strip 142 to fold over front support frame 102, left-side support frame 104, rear support frame 106, and right-side support frame 108, respectively, allowing first adhesive strip 142 to affix to second adhesive strip 144.

Figure 6:
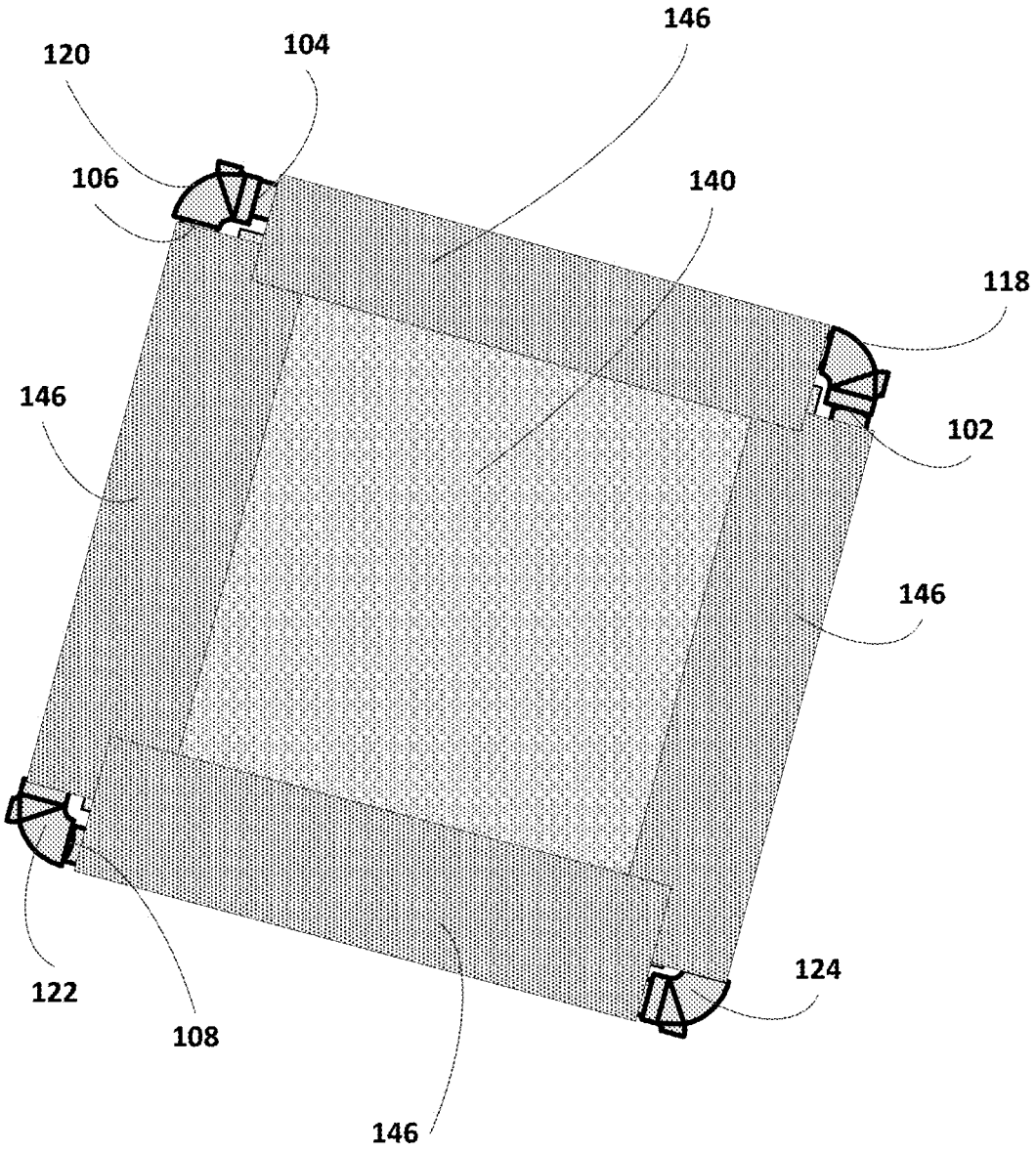
FIG. 6 shows the underside of the top sheet with the adhesive strips connected from FIG. 5.

FIG. 6 illustrates a bottom view of the embodiment of the portable table 100 shown in FIG. 5 with the top frames and hubs assembled and placed over the underside of the top sheet 140, which is affixed to the frame. Leg frames are not shown in this illustration. Portable table 100, in this embodiment, includes front support frame 102, left-side support frame 104, rear support frame 106, and right-side support frame 108 which are underneath the folded flaps. Front support frame 102 and left-side support frame 104 are separably connected by front left hub 118. Similarly, left-side support frame 104 and rear support frame 106 are separably connected by rear left hub 120, rear support frame 106 and right-side support frame 108 are separably connected by rear right hub 122, and right-side support frame 108 and front support frame 102 are separably connected by front right hub 124.

Also shown in the example embodiment in FIG. 6 is top sheet 140. This embodiment illustrates the underside of the top sheet 140. Top sheet 140 includes flaps 146 which extend over front support frame 102, left-side support frame 104, rear support frame 106, and right-side support frame 108 which are underneath the folded flaps. In this embodiment, each flap 146 has been wrapped around front support frame 102, left-side support frame 104, rear support frame 106, and right-side support frame 108, respectively. As not shown in FIG. 6, but as shown in FIG. 5, first adhesive strips 142 and second adhesive strips 144 allow the top sheet to be connected to the front support 102, rear support 106, left-side support 104, and right-side support 108 by affixing the first adhesive strip 142 to the second adhesive strip 144.

Figure 7:
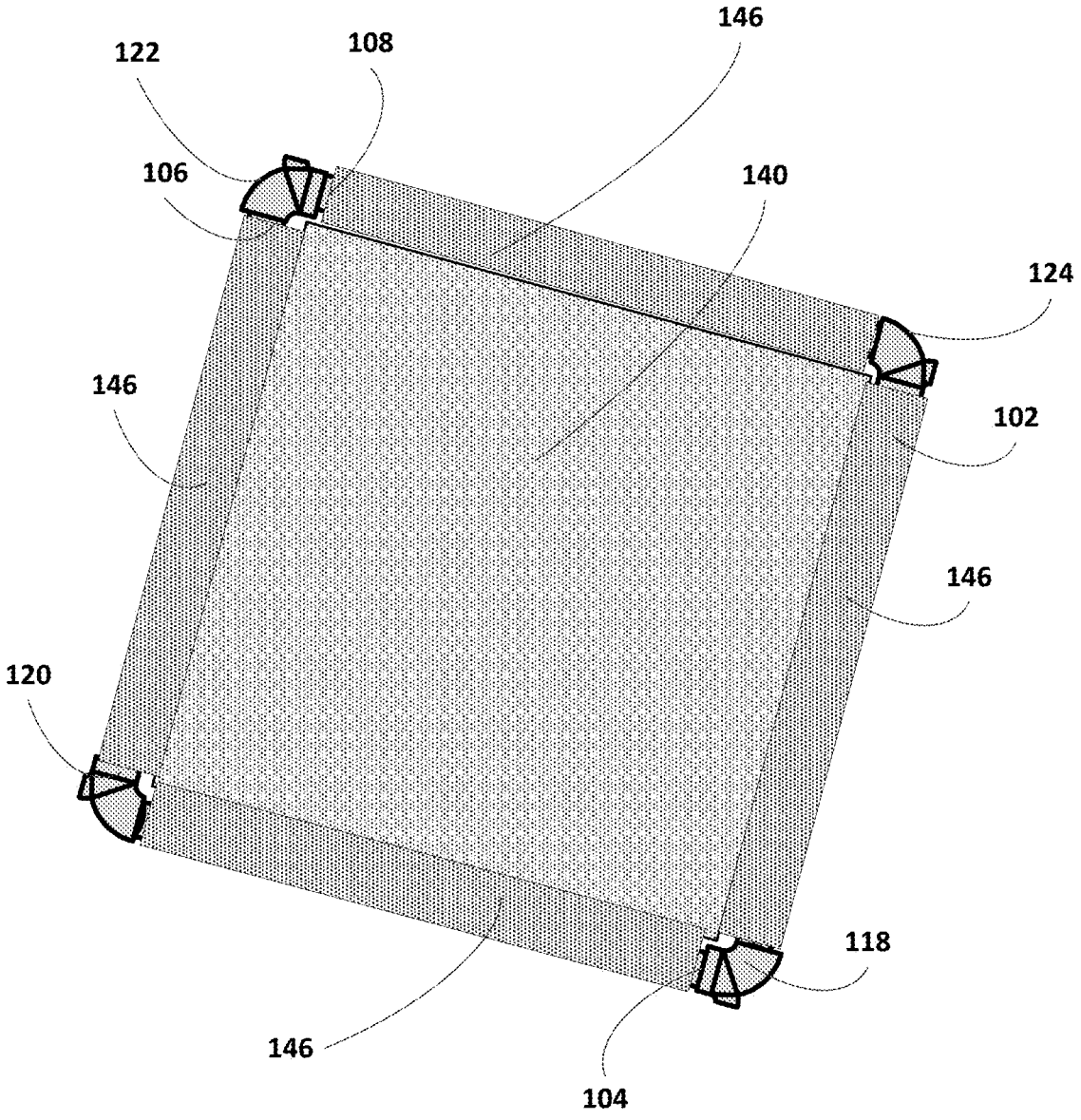
FIG. 7 shows the top side of the top sheet from FIG. 6 with the adhesive strips connected forming the top of the portable table.

FIG. 7 illustrates a top view of an embodiment of the portable table 100 with the top frames and hubs assembled and placed underneath the top sheet 140, which is affixed to front support frame 102, left-side support frame 104, rear support frame 106, and right-side support frame 108 which are underneath the folded flaps. Leg frames are not shown in this illustration. Portable table 100, in this embodiment, includes front support frame 102, left-side support frame 104, rear support frame 106, and right-side support frame 108. Front support frame 102 and left-side support frame 104 are separably connected by front left hub 118. Similarly, left-side support frame 104 and rear support frame 106 are separably connected by rear left hub 120, rear support frame 106 and right-side support frame 108 are separably connected by rear right hub 122, and right-side support frame 108 and front support frame 102 are separably connected by front right hub 124.

Also shown in the example embodiment in FIG. 7 is a top view of top sheet 140 attached to the connected frame. Top sheet 140 includes flaps 146 which extend over front support frame 102, left-side support frame 104, rear support frame 106, and right-side support frame 108. In this embodiment, each flap 146 has been wrapped around the respective support frames. As not shown in FIG. 7, but as shown in FIG. 5, first adhesive strips 142 and second adhesive strips 144, both placed on the underside of top sheet 140, allow the top sheet to be coupled to the front support 102, rear support 106, left-side support 104, and right-side support 108 by affixing the first adhesive strip 142 to the second adhesive strip 144.

While the exemplary embodiments have been shown and described, it will be understood by those skilled in the art that various changes in form and details may be made thereto without departing from the spirit and scope of the present disclosure as defined by the appended claims.

In addition, many modifications can be made to adapt a particular situation or material to the teachings of the present disclosure without departing from the essential scope thereof. Therefore, it is intended that the present disclosure not be limited to the particular exemplary embodiments disclosed as the best mode contemplated for carrying out the present disclosure, but that the present disclosure will include all embodiments falling within the scope and function of the claims.

Various features and advantages of some embodiments are set forth in the following claims.

What is claimed is:

1. A portable table comprising:

a front left hub, a front right hub, a rear left hub, and a rear right hub;

a front support frame separably connecting the front left and the front right hubs to each other;

a rear support frame separably connecting the rear left and the rear right hubs to each other;

a left-side support frame separably connecting the front left and the rear left hubs to each other;

a right-side support frame separably connecting the front right and the rear right hubs to each other;

front left, front right, rear left, and rear right leg frames separably connected respectively to the front left hub, front right hub, rear left hub, and rear right hub having base ends separably coupled to a lower outer peripheral surface of the respective hubs and respectively having leg caps attached to the free ends of the leg frames that extend toward the ground surface; and a top sheet coupled to the front support, rear support, left-side support, and rear-side support frames respectively, wherein each of the front support frame, rear support frame, left-side support frame, right-side support frame, the front left leg frame, front right leg frame, rear left leg frame, and rear right leg frame, is connected to at least one frame other than itself through one or more of a plurality of elastic strings, the plurality of elastic strings passing through the hubs and connected to the leg caps, and wherein the front support frame, rear support frame, left-side support frame, right-side support frame, the front left leg frame, front right leg frame, rear left leg frame, and rear right leg frame are all formed as a hollow tube, wherein the plurality of elastic strings are disposed so as to pass through the inside of the respective frames and the hubs, and wherein each of the plurality of elastic strings is configured with one end coupled to a leg cap and its opposite end coupled to another elastic string.

2. The portable table according to claim 1, wherein the top sheet comprises a material selected from the group consisting of fabric, plastic, and rubber.

3. The portable table according to claim 1, wherein the top sheet includes at least one pocket into which items may be inserted.

4. The portable table according to claim 1, wherein the top sheet is coupled to at least one of the front support, rear support, left-side support, and rear-side support frames respectively by wrapping the top sheet around the respective frame wherein a first adhesive strip attached at the end of the top sheet connects to a second adhesive strip coupled to the top sheet in a position allowing the first adhesive strip to affix to the second adhesive strip.

5. The portable table according to claim 1, wherein the outer surface of the hub comprises coupling holes respectively corresponding to the base ends of the front and rear support frames and the front and rear leg frames, wherein the base ends of the front and rear support frames and the front and rear leg frames are separably inserted into the respective coupling holes.

6. The portable table according to claim 1, wherein the front left leg frame and the front right leg frame are of different length than the rear left leg frame and the rear right leg frame.

7. The portable table according to claim 1, wherein a fastener is coupled to the inside of at least one of the leg caps and wherein at least one of the plurality of elastic strings is coupled to the fastener.

* * * * *